US006729096B1

(12) United States Patent
Ashmore et al.

(10) Patent No.: US 6,729,096 B1
(45) Date of Patent: May 4, 2004

(54) SYSTEM FOR INSTALLING SUSPENDED CEILING

(75) Inventors: Gary D. Ashmore, Tulsa, OK (US); Mike Hensley, Broken Arrow, OK (US)

(73) Assignee: AAON Inc., Tulsa, OK (US)

( * ) Notice: Subject to any disclaimer, the term of this patent is extended or adjusted under 35 U.S.C. 154(b) by 0 days.

(21) Appl. No.: 10/237,501

(22) Filed: Sep. 9, 2002

(51) Int. Cl.[7] ..... E04B 2/00; E04B 5/00; E04B 9/00

(52) U.S. Cl. ..... 52/506.06; 52/664; 52/665; 52/730.6; 52/730.1; 52/733.1

(58) Field of Search ..... 52/506.06, 22, 52/664, 665, 730.6, 730.1, 733.1

(56) References Cited

U.S. PATENT DOCUMENTS

| | | | | | |
|---|---|---|---|---|---|
| 3,352,071 | A | * | 11/1967 | Sutter | 52/28 |
| 3,486,311 | A | * | 12/1969 | Allon, Jr. | 55/355 |
| 3,842,561 | A | * | 10/1974 | Wong | 52/506.07 |
| 3,848,385 | A | * | 11/1974 | Thompson | 52/506.06 |
| 3,859,770 | A | * | 1/1975 | Chambers et al. | 52/745.05 |
| 3,936,990 | A | * | 2/1976 | Garrison et al. | 52/718.01 |
| 4,416,095 | A | * | 11/1983 | Truluck | 52/506.07 |
| 4,483,116 | A | | 11/1984 | Gailey | |
| 4,713,919 | A | | 12/1987 | Platt | |
| 4,947,607 | A | | 8/1990 | Stein | |
| 5,077,951 | A | | 1/1992 | Baker | |
| 5,279,090 | A | * | 1/1994 | Yamaguchi et al. | 52/506.08 |
| 5,349,800 | A | * | 9/1994 | Peng | 52/506.06 |
| 5,397,090 | A | | 3/1995 | Carson et al. | |
| 5,482,240 | A | | 1/1996 | Caraher | |
| 5,619,833 | A | * | 4/1997 | Neff | 52/506.07 |
| 5,687,525 | A | * | 11/1997 | Koski et al. | 52/506.07 |
| 5,732,521 | A | * | 3/1998 | Schmitt-Raiser | 52/506.07 |
| 5,740,994 | A | | 4/1998 | Laughlin | |
| 5,979,134 | A | | 11/1999 | Neff | |
| 6,027,091 | A | * | 2/2000 | Johnson | 248/340 |
| 6,047,517 | A | * | 4/2000 | Vrame | 52/733.3 |
| 6,138,416 | A | | 10/2000 | Platt | |
| 6,318,042 | B1 | * | 11/2001 | Bloom et al. | 52/506.07 |
| 6,446,406 | B1 | * | 9/2002 | Sauer | 52/506.06 |

* cited by examiner

*Primary Examiner*—Carl D. Friedman
*Assistant Examiner*—Nahid Amiri
(74) *Attorney, Agent, or Firm*—Molly D. McKay

(57) ABSTRACT

A system for installing suspended ceilings in large commercial buildings employing t-shaped main and intersecting branch ceiling joists. The main joists are suspended from the purlins of the building by upper brackets that secure to the purlins and by lower brackets that secure to the joists. Rods that are adjustable in length attach the upper brackets to the lower brackets to thereby suspend the joists below the purlins. To install the joists, the rods are adjusted in length so that all the joists are level and are suspended at the desired height within the building. The main joists are spaced approximately 8 feet apart from each other, and the branch joists are spaced approximately 4 feet apart from each and attach to the main joists at right angles so as to form a plurality of frames for supporting 4×8 foot sheets of insulated ceiling board.

4 Claims, 7 Drawing Sheets

SYSTEM FOR INSTALLING SUSPENDED CEILING

BACKGROUND OF THE INVENTION

1. Field of the Invention

The present invention relates to a system for installing suspended ceiling in large commercial buildings that have spans of hundreds of feet between their outside walls. Current support systems for suspending insulating ceiling tiles are not strong enough to suspend ceilings in these types of large buildings. The present invention makes installation of suspended ceilings possible.

2. Description of the Related Art

Large commercial buildings of the type spanning hundreds of feet are generally constructed of metal. These large buildings generally do not have a ceiling but instead the interior of the building extends to the metal that forms the roof of the building. Generally metal purlins support the roof of this type of building. Because of the large space overhead, these buildings are hard to light and hard to heat and cool. Also, the acoustics in these types of buildings make them noisy places where it is hard to communicate. Installation of a suspended ceiling in these large commercial buildings could reduce operational costs and make the building a more pleasant work environment. However, the support systems currently available for suspending ceilings are not strong enough to span the long lengths and widths required for these types of commercial buildings. Currently available systems for installing suspended ceilings are designed for much smaller installations.

The present invention addresses this problem by providing a system for installing suspended ceilings in large commercial buildings. The present system employs ceiling supports that are t-shaped ceiling joists. These t-shaped joists are employed for both the main joists and for the intersecting branch joists.

The joists are suspended from the purlins of the building by upper brackets that secure to the purlins and by lower brackets that secure to the joists. Rods that are adjustable in length attach the upper brackets to the lower brackets, and thereby, suspend the joists below the purlins. When the joists are installed, the rods are adjusted in length so that all the joists are level and are suspended at the desired height within the building.

The main joists are preferably spaced approximately 8 feet apart from each other, and the branch joists are preferably spaced approximately 4 feet apart from each. The branch joists are located at right angles to the main joists so that together the main and intersecting branch joists form a plurality of frames to support 4×8 foot sheets of insulated ceiling board. Together the joists and the ceiling boards form the suspended ceiling for the building.

SUMMARY OF THE INVENTION

The present invention is a system for installing suspended ceilings in large commercial buildings. The present system employs ceiling supports that are t-shaped ceiling joists for both the main joists and for the intersecting branch joists.

The joists are suspended from the purlins of the building by upper brackets that secure to the purlins and by lower brackets that secure to the joists. Rods that are adjustable in length attach the upper brackets to the lower brackets to thereby suspend the joists below the purlins. When the joists are installed, the rods are adjusted in length so that all the joists are level and are suspended at the desired height within the building.

The main joists are preferably spaced approximately 8 feet apart from each other, and the branch joists are preferably spaced approximately 4 feet apart from each and at right angles to the main joists so that together the main and intersecting branch joists form a plurality of frames. Each frame supports a 4×8 foot sheet of insulated ceiling board. Together the joists and the ceiling boards form the suspended ceiling for the building.

DETAILED DESCRIPTION OF THE PREFERRED EMBODIMENT

Figure 1:
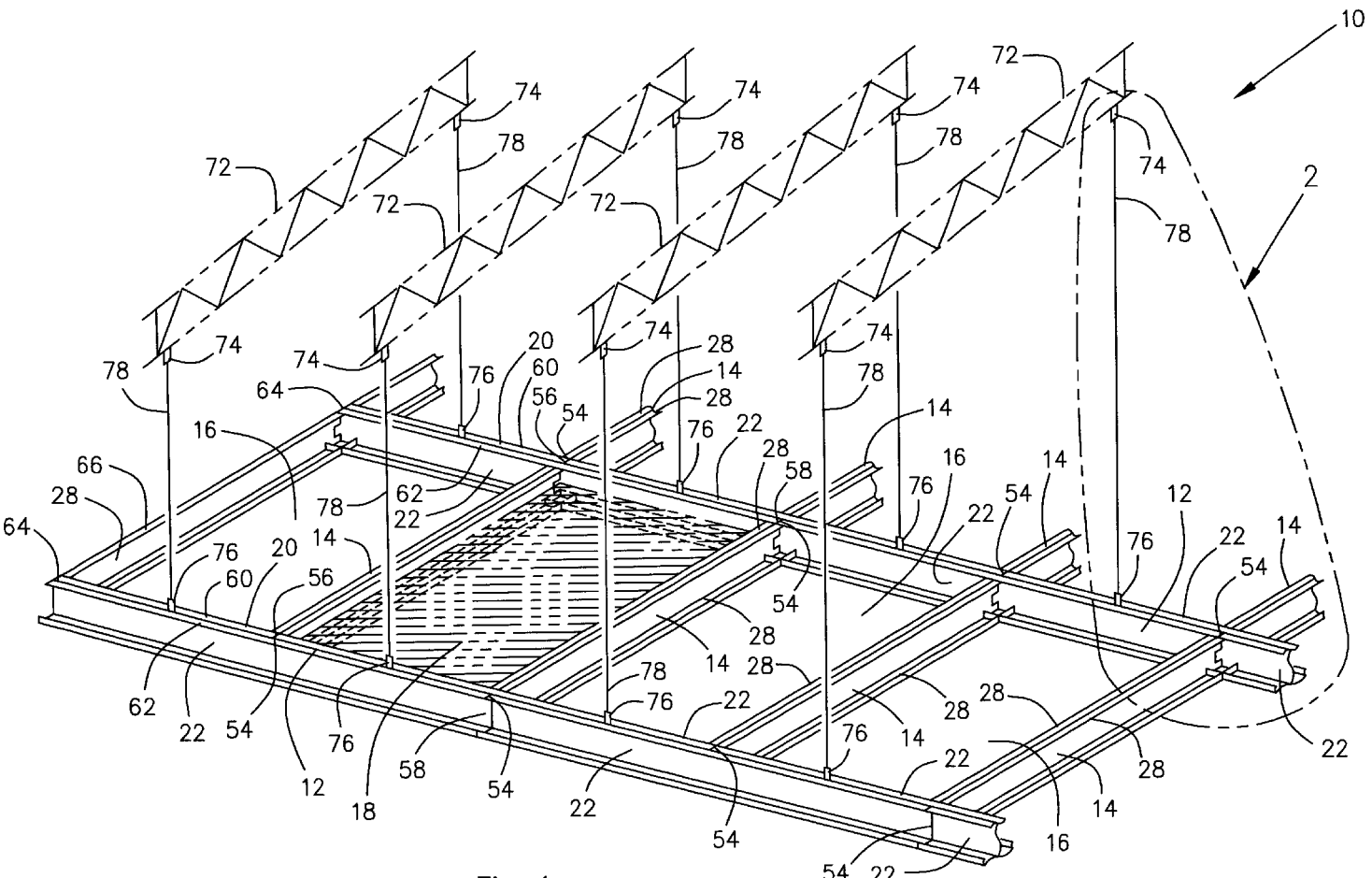
FIG. 1 is a perspective view of a suspended ceiling system constructed in accordance with a preferred embodiment of the present invention, shown installed to the purlins of a building.

Referring now to the drawings and initially to FIG. 1, there is illustrated a system for installing suspended ceilings 10 in large commercial buildings constructed in accordance with a preferred embodiment of the present invention. The present system 10 employs two types of ceiling supports or ceiling joists: t-shaped main joists 12 and t-shaped branch joists 14. The main joists 12 span the width of the building and the branch joists 14 extend between adjacent main joists 12 to intersect the main joists 12 at right angles, thereby forming oblong frames 16 for supporting ceiling panels 18.

Each main joist 12 is constructed of a series of j-shaped main subcomponents 20 and 22 that are secured together along their back sides, 24 and 26 to form the t-shaped joists, as will be more fully described hereafter. Also, each branch joist 14 is constructed of two identical j-shaped branch subcomponents 28 that are secured together along their back sides 29. Each of the branch subcomponents 28 is approximately 8 foot long. The main subcomponents 20 and 22 are secured together with nuts 30 and bolts 32 that insert through bolt openings 34 provided in the subcomponents 20 and 22.

Likewise each branch subcomponents 28 is secured together with nuts 30B and bolts 32B that insert through bolt openings 36 provided in the branch subcomponents 28. Each j-shaped branch subcomponent 28 is approximately 8 feet long. When two branch subcomponents 28 secured together to form a branch joist 14, both ends 38 of the pair are flush with one another.

Figure 17:
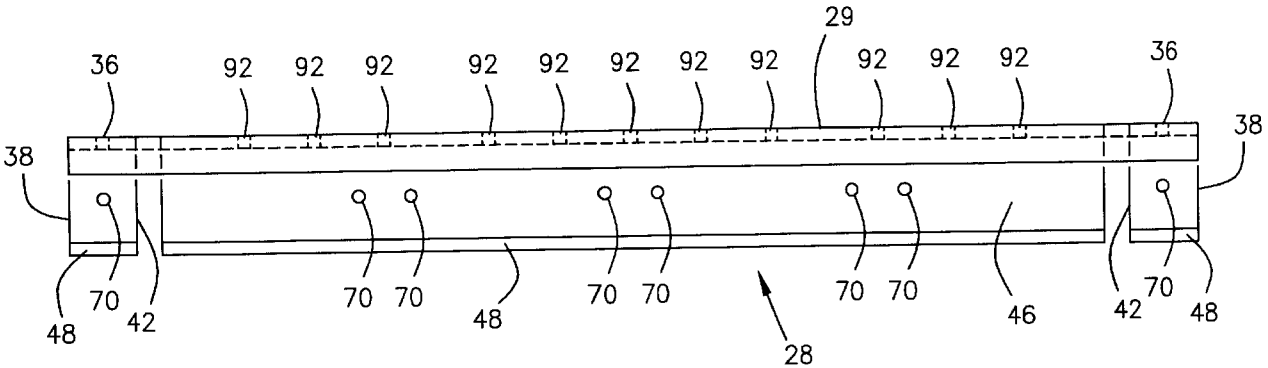
FIG. 17 is a top plan view of the branch joist component taken along line 17—17 of FIG. 15.
Figure 16:
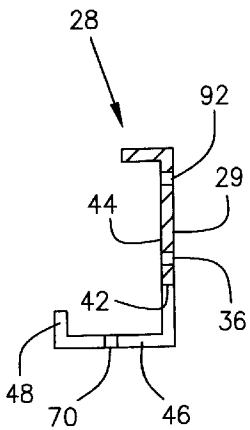
FIG. 16 is a cross sectional view of the branch joist component taken along line 16—16 of FIG. 15.
Figure 15:
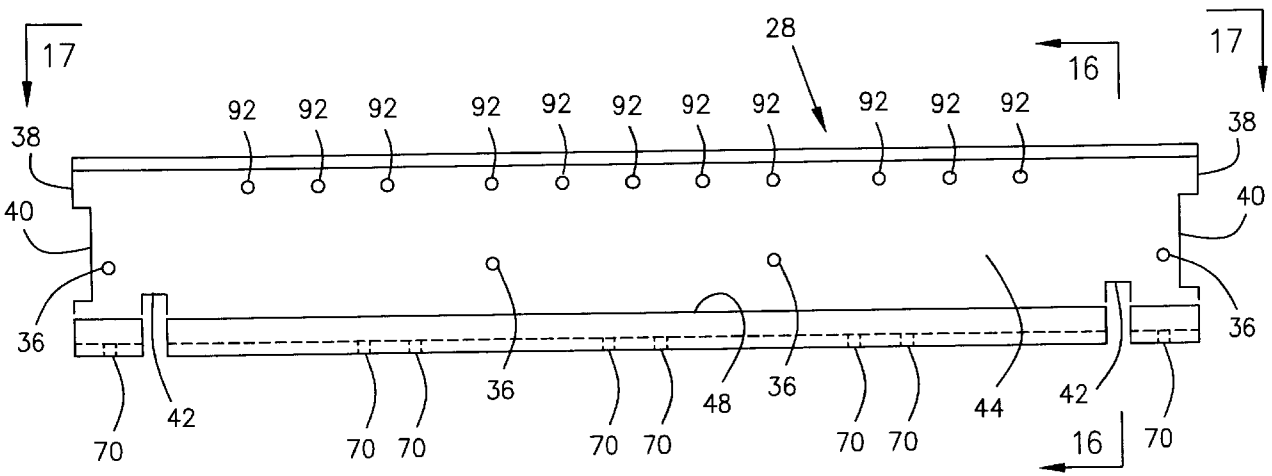
FIG. 15 is a side view of a branch joist component employed in the system of FIG. 1.

As illustrated in FIGS. 15–17, each end 38 of the branch subcomponents 28 is provided with an end notch 40. Also, each branch subcomponent 28 is provided with a bottom notch 42 that extends up into the main portion 44 of the subcomponent 28 and extends completely through a long leg 46 of the j-shaped branch subcomponent 28 and completely through an upwardly extending lip 48 provided on the long leg 46. When the branch subcomponents 28 are secured together to form the branch joists 14, end notches 40 of the pairs of branch subcomponents 28 coincide or align with each other to form a single combined end notch 40C at both combined ends 38C of the branch subcomponents 28.

The bottom notches 42 in the branch subcomponents 28 also align linearly with each other when the branch joists 14 are created, thereby formed a branch joist 14 with a combined bottom notch 42C that is linearly aligned and extends through a combined main portion 40C of the branch joist 14, through the long legs 46, and through both upwardly extending lips 48.

Figure 4:
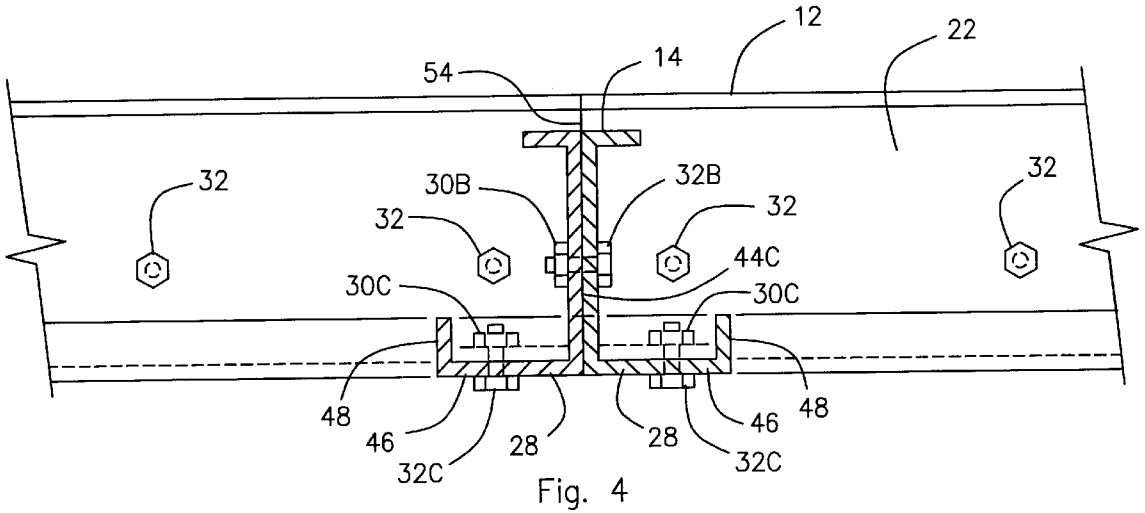
FIG. 4 is a cross sectional view of a branch joist taken along line 4—4 of FIG. 2.
Figure 3:
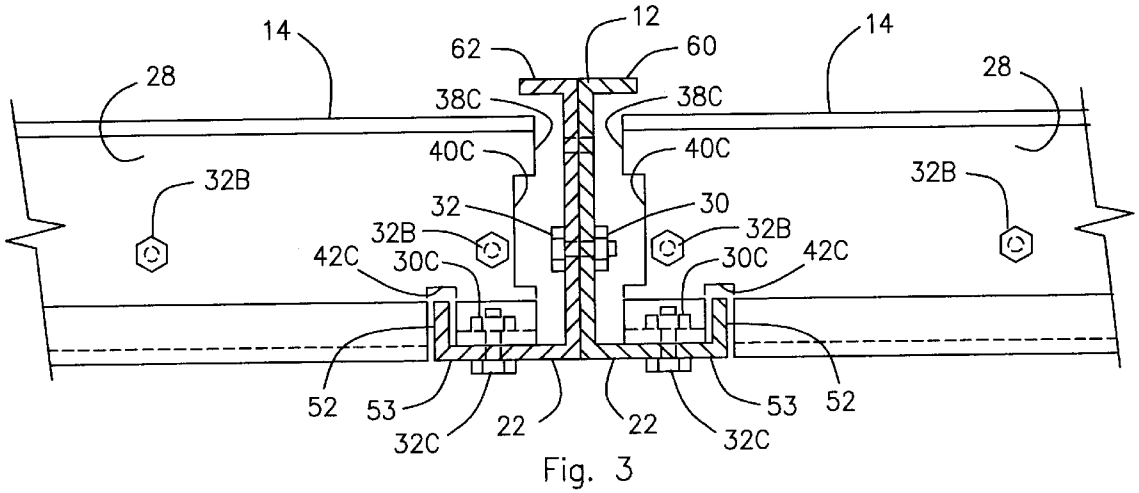
FIG. 3 is a cross sectional view of a main joist taken along line 3—3 of FIG. 2, shown with the lower attachment bracket removed.
Figure 8:
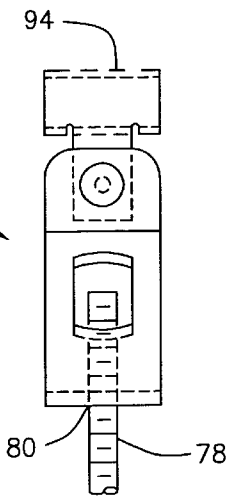
FIG. 8 is a front view of an upper bracket taken along line 8—8 for FIG. 7.
Figure 7:
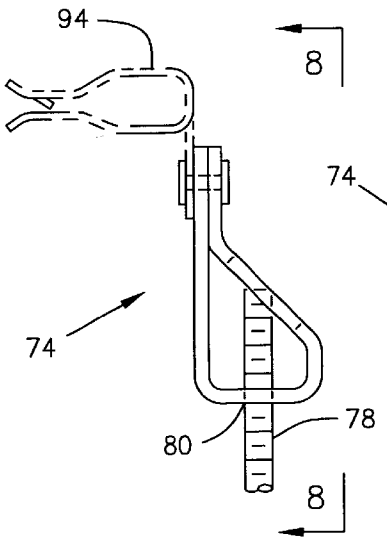
FIG. 7 is a side view of an upper bracket taken along line 7—7 of FIG. 2.
Figure 6:
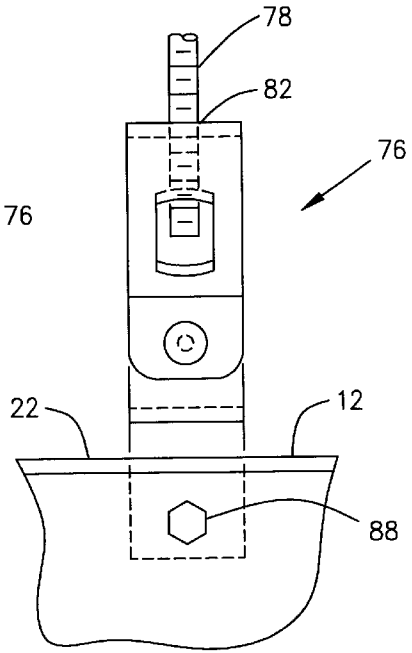
FIG. 6 is a front view of a lower bracket taken along line 6—6 of FIG. 5.

As illustrated in FIGS. 3 and 4, the combined end notches 40C on the branch joists 14 are provided to allow the branch joists 14 to be positioned perpendicular to the main joists 12. In thus positioning the branch joists 14, the combined end notches 40C are needed to allow the combined ends 38C of the branch joists 14 to be pushed past bolts 32 that secure together the main subcomponents 20 and 22 that form the main joists 12. And also when the branch joists 14 are attached to the main joists 12, the aligned combined bottom notches 42C of the branch joists 14 receive upturned lips 50 and 52 provided respectively on the main subcomponents 20 and 22 of the main joists 12.

Figure 2:
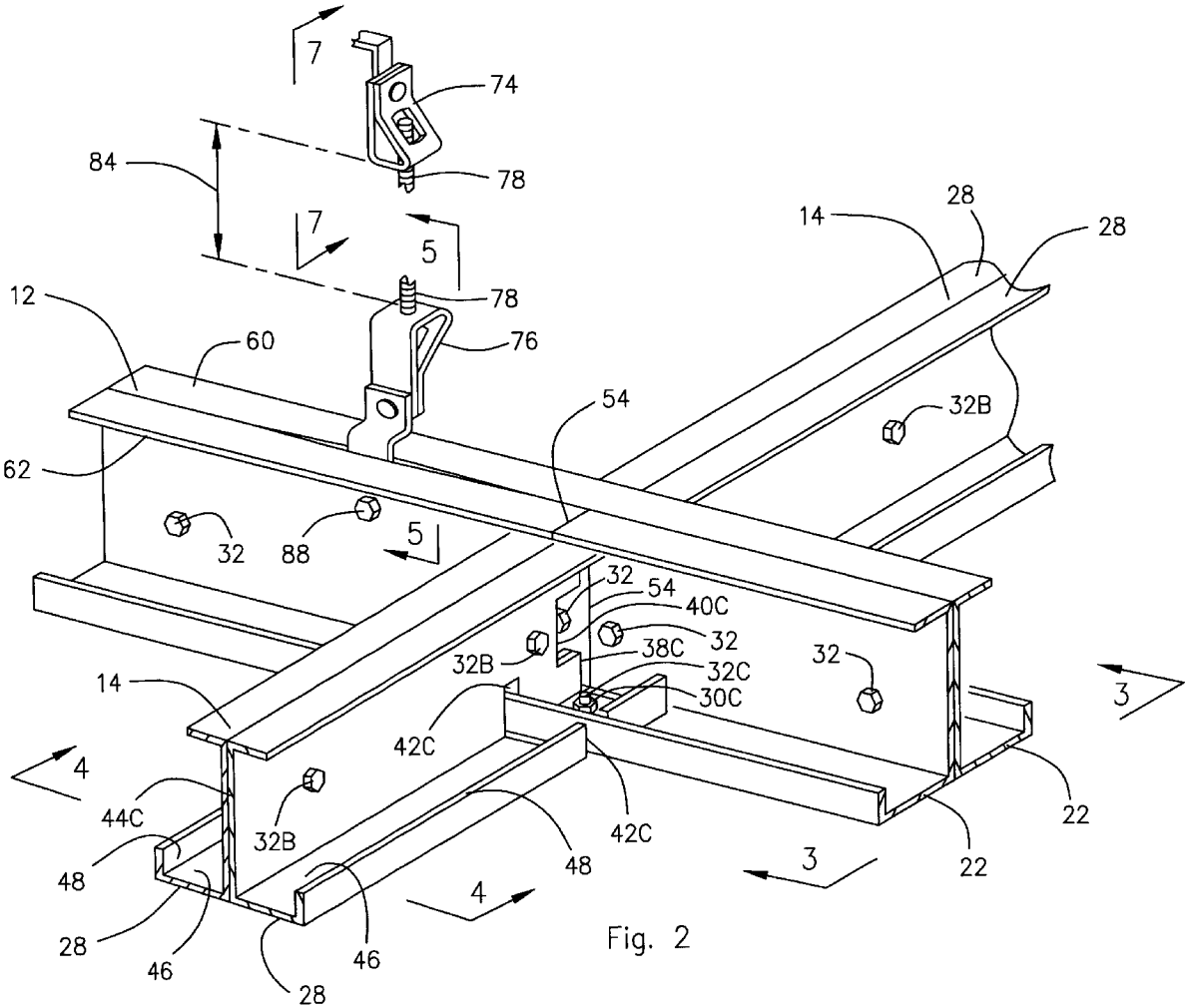
FIG. 2 is an enlarged view of the portion of FIG. 1 enclosed within circle number 2 showing the details of the suspended ceiling system.
Figure 11:
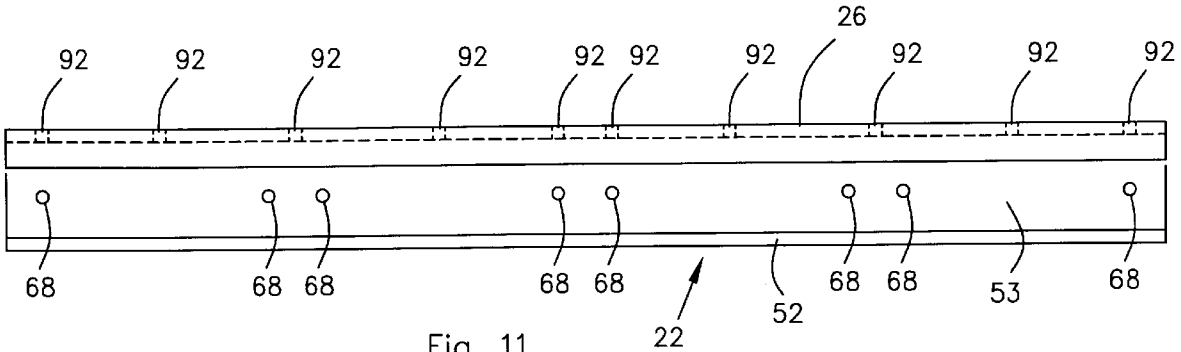
FIG. 11 is a top plan view of the 96 inch main joist component taken along line 11—11 of FIG. 9.
Figure 10:
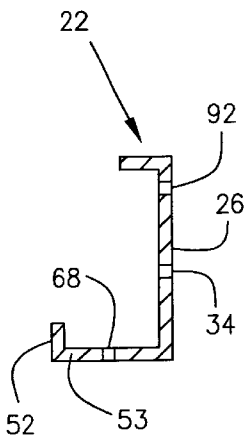
FIG. 10 is a cross sectional view of the 96 inch main joist component taken along line 10—10 of FIG. 9.
Figure 9:
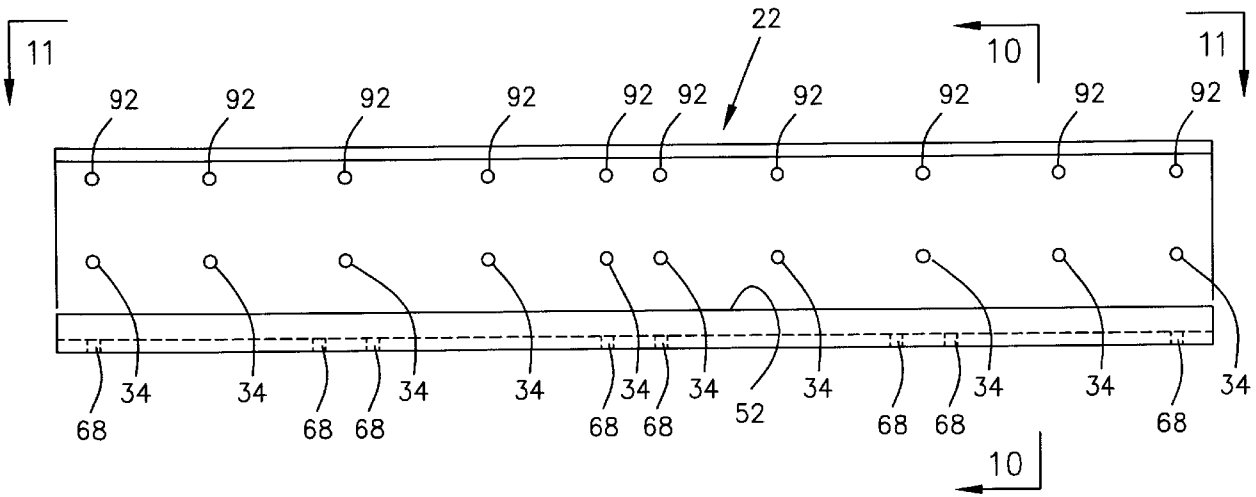
FIG. 9 is a side view of a 96 inch long main joist component employed in the system of FIG. 1.
Figure 13:
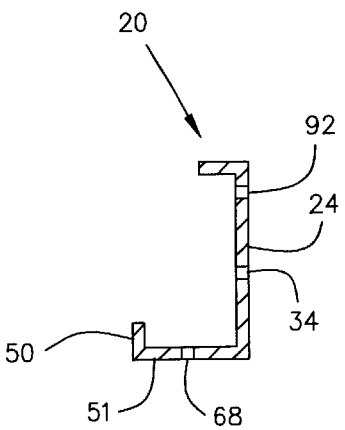
FIG. 13 is a cross sectional view of the 48 inch main joist component taken along line 13—13 of FIG. 12.
Figure 14:
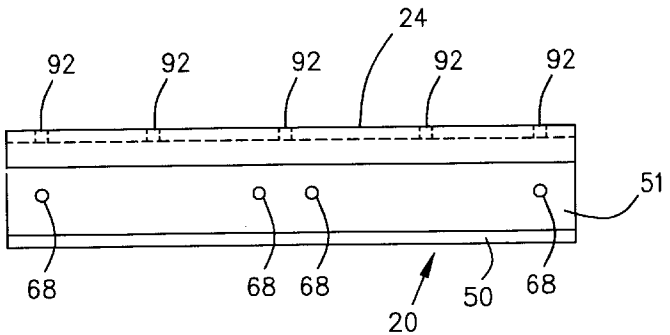
FIG. 14 is a top plan view of the 48 inch main joist component taken along line 14—14 of FIG. 12.
Figure 12:
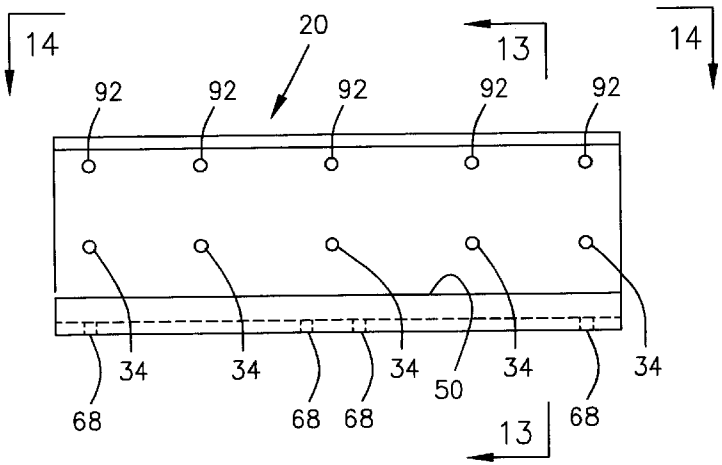
FIG. 12 is a side view of a 48 inch long main joist component employed in the system of FIG. 1.

Referring now to FIGS. 1 and 2, each main joist 12 is constructed of j-shaped main subcomponents 20 and 22 that are staggered so that the joints 54 between abutting ends, 56 and 58 respectively for main subcomponents 20 and 22, of the main subcomponents 20 and 22 on a first side 60 of the main joist do not coincide with the joints 54 on the opposite second side 62 of the main joist 12. This staggered arrangement of joints 54 in construction of the main joists 12 results in added strength. In order to stagger these joints 54, construction of a main joist 12 requires two different lengths of main subcomponents 20 and 22. The first type of main subcomponent 20 is approximately 48 inches long, as illustrated in FIGS. 12–14, and the second type of main subcomponent 22 is approximately 96 inches long, as illustrated in FIGS. 9–11.

Construction of a main joist 12 begins by employing a 48 inch main subcomponent 20 on the first side 60 of the main joist 12 in conjunction with a 96 inch length main subcomponent 22 on the other side 62 of the main joist 12 so that these two main subcomponents 20 and 22 are flush with each other on one end, i.e. the beginning end 64, but are staggered on their opposite ends, 56 and 58 respectively. These first two main subcomponents 20 and 22 are secured together with nuts 30 and bolts 32 that insert through bolt openings 36 provided in the main subcomponents 20 and 22. Then, the main joist 12 is lengthened to the desired length, i.e. the width of the building. This is done by securing additional 96 inch length main subcomponents 22 at ends 56 and 58 of the main joist 12 and continuing to add subcomponents 22 thereafter at the ends 58 of the previous subcomponent 22 on each side 60 and 62 of the main joist 12 until the main joist 12 spans the width of the building. This results in main joists 12 with perfectly staggered joints 54. Additional main joists 12 are constructed until the entire area where the suspended ceiling 10 is being installed is provided with main joists 12 that are spaced approximately 8 feet apart from each other. As illustrated in FIG. 1, a series of branch subcomponents 28 are secured between adjacent beginning ends 64 of the main joists 12 and between adjacent opposite ends (not illustrated) of the main joists 12 to form frames 16 at the sides 66 of the ceiling 10 where the main joists 12 intersect with the walls of the building.

Referring now to FIG. 2, the main joists 12 are slightly taller than the branch joists 14 so that the two types of joists 12 and 14 secure together properly where the branch joists 14 intersect with the main joists 12. The branch joists 14 are secured to the main joists 12 with nuts 30C and bolts 32C that insert through bolt openings 68 and 70 provided respectively in the main and branch joists 12 and 14 for this purpose. As shown on FIGS. 15–17, additional bolt openings 70 are provided along the length of the branch subcomponents 28 for use if the branch joists 14 need to be shortened, such as for example at the sides 66 of the ceiling 10.

Referring now to FIGS. 1, 2 and 5–8, the main joists 12 are suspended from the purlins 72 or rafters of the building by upper brackets 74 that secure to the purlins 72 and by lower brackets 76 that secure to the main joists 12. Rods 78 that are adjustable in length attach the upper brackets 74 to the lower brackets 76 to thereby suspend the main joists 12 below the purlins 72. Later when the branch joists 14 are attached to the, main joists 12 and when the ceiling panels 18 are supported by the frames 16 formed by the joists 12 and 14, the rods 78 and brackets 74 and 76 support the entire suspended ceiling 10, including joists 12 and 14 and the ceiling panels 18.

Each rod 78 is threaded at least on its ends. When the main joists 12 are installed, each rod 78 is adjusted in length by either rotating the threaded rod 78 relative to one or both brackets 74 and 76 or rotating one or both of the brackets 74 and 76 relative to the threaded rod 78. Each bracket 74 and 76 has a female threaded rod receiving opening, 80 and 82 respectively, provided therein for engagement by its associated threaded rod 78 to allow the effective length 84 of the rod 78 to be either shortened or lengthened, as the situation may require. As illustrated in FIG. 2, the effective length 84 of the rod 78 is measured between the upper bracket 74 and its associated lower bracket 76. Rotation of the rod 78 relative to one or both of the upper and lower brackets 74 and 76 moves the brackets either closer together or further apart, thereby either effectively shortening or lengthening the rod 78, which in turn results in either raising or lowering the main joists 12 within the building.

Figure 5:
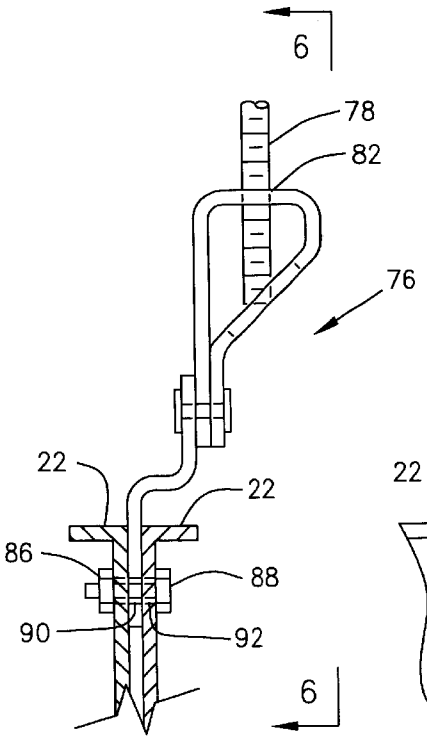
FIG. 5 is a side view of a lower bracket taken along line 5—5 of FIG. 2.

This procedure is used to adjust the rods 78 so that all the main joists 12 in the building are level and are suspended at the desired height. As best illustrated in FIG. 5, each of the lower brackets 76 preferably attaches to one of the main joists 12 via a nut 86 and bolt 88, with the bolt 88 inserting through bolt openings 90 and 92. Bolt openings 90 are provided in the lower bracket 76. Bolt openings 92 are provided in the main subcomponents 20 and 22 and in the main joist 12. Bolt openings 92 are also provided in the branch subcomponent 28 and the branch joists 14 in the event that it is desirable to support the branch joists 14 from the purlins 72 via additional brackets 74 and 76 and rods 78. Each of the upper brackets 74 preferably attaches to a purlin 72 of the building via a clamp 94 that is attached to the upper bracket 74. The clamp 94 is the preferably used for ease of installation, however, other means of attaching the upper brackets 74 to the purlins 72 may be employed, such as for example, nuts and bolts or other suitable means.

The main joists 12 are preferably spaced approximately 8 feet apart from each other, and the branch joists 14 are preferably spaced approximately 4 feet apart from each and at approximately right angles to the main joists 12 so that together the main and intersecting branch joists 12 and 14 form a plurality of frames 16. Each frame 16 supports a 4×8 foot sheet of insulated ceiling board or ceiling panel 18. Together the joists 12 and 14, the brackets 74 and 76 and rods 78 that support the joists 12 and 14, and the ceiling panels 18 form the suspended ceiling 10 for the building.

Although the invention has been described as employing nuts and bolts to fasten it together, the invention is not so limited. Any suitable fastening device, such as for example metal screws, may be employed in place of the nuts and bolts described above for this invention.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A suspended ceiling comprising:

main subcomponents secured together to form main joists, branch subcomponents secured together to form branch joists, the main joists suspended from purlins of a building, the main joists spaced apart from each other in approximately parallel arrangement, each branch joist secured on its two ends to a pair of adjacent main joists to form frames for receiving a ceiling panel, each main subcomponents being j-shaped so that it has a long leg provided on it, the main subcomponents being secured together back to back and end to end so that the joints formed between the main subcomponents on one side of the main joist are staggered with respect to the joints formed between the main subcomponents on the other side of the main joist.

2. A suspended ceiling according to claim 1 wherein each branch joist further comprises:

a pair of branch subcomponents being secured together back to back with their ends flush with each other to form each branch joist, a notch provided in each end of each branch joist.

3. A suspended ceiling according to claim 1 wherein the main joists are spaced approximately 8 feet apart from each other and the branch joists are spaced approximately 4 feet apart from each other.

4. A suspended ceiling according to claim 1 further comprising:

an upwardly extending lip provided on each main joist and an upwardly extending lip provided on each branch joist, a notch provided in the long leg and lip of each end of each branch joist for receiving the lip of a main joist when the branch joists are attached to the main joists.

* * * * *